US008771409B2

(12) United States Patent
Asakawa et al.

(10) Patent No.: US 8,771,409 B2
(45) Date of Patent: Jul. 8, 2014

(54) ELECTROLESS GOLD PLATING SOLUTION AND ELECTROLESS GOLD PLATING METHOD

(75) Inventors: Takanobu Asakawa, Hiratsuka (JP); Tomoyuki Fujinami, Hiratsuka (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 257 days.

(21) Appl. No.: 13/388,752

(22) PCT Filed: Apr. 15, 2011

(86) PCT No.: PCT/JP2011/059350

§ 371 (c)(1),
(2), (4) Date: Feb. 3, 2012

(87) PCT Pub. No.: WO2012/011305

PCT Pub. Date: Jan. 26, 2012

(65) Prior Publication Data

US 2012/0129005 A1 May 24, 2012

(30) Foreign Application Priority Data

Jul. 20, 2010 (JP) ..... 2010-162603

(51) Int. Cl.
*C23C 18/42* (2006.01)
*C23C 18/44* (2006.01)

(52) U.S. Cl.
USPC ..... 106/1.23; 106/1.26

(58) Field of Classification Search
CPC .... C23C 18/42; C23C 18/44; C23C 18/1637; B32B 15/018
USPC ..... 106/1.23, 1.26; 427/437; 428/672
See application file for complete search history.

(56) References Cited

U.S. PATENT DOCUMENTS

| | | | | | |
|---|---|---|---|---|---|
| 4,483,887 | A | * | 11/1984 | Garcia | 106/1.23 |
| 5,035,744 | A | * | 7/1991 | Nishiyama et al. | 106/1.23 |
| 5,198,273 | A | | 3/1993 | Ando et al. | 427/437 |
| 5,364,460 | A | | 11/1994 | Morimoto et al. | 106/1.23 |
| 5,470,381 | A | * | 11/1995 | Kato et al. | 106/1.23 |
| 5,803,957 | A | * | 9/1998 | Murakami et al. | 106/1.26 |
| 2008/0138507 | A1 | | 6/2008 | Kiso et al. | 427/99.5 |
| 2008/0277140 | A1 | | 11/2008 | Kurosaka et al. | 174/126.1 |

FOREIGN PATENT DOCUMENTS

| | | |
|---|---|---|
| JP | 6-145997 | 5/1994 |
| JP | 06-330336 | 11/1994 |
| JP | 07-292477 | 11/1995 |
| JP | 2866676 | 3/1999 |
| JP | 2004-137589 | 5/2004 |
| JP | 2008-144188 | 6/2008 |
| JP | 2008-174774 | 7/2008 |
| JP | 2008-266668 | 11/2008 |
| WO | WO 2004/111287 | 12/2004 |

* cited by examiner

*Primary Examiner* — Helene Klemanski
(74) *Attorney, Agent, or Firm* — Roberts & Roberts, LLP

(57) ABSTRACT

It is an object of the present invention to provide an electroless gold plating solution capable of directly subjecting a plated coating film made of an underlying metal such as nickel or palladium to gold plate processing, of forming a thick gold plated coating film having a thickness of 0.1 μm or more, of forming a uniform gold plated coating film, and of safely performing plating work. The present invention relates to an electroless gold plating solution comprising: a water-soluble gold compound; and hexahydro-2,4,6-trimethyl-1,3,5-triazine or hexamethylenetetramine. Preferably, the electroless gold plating solution comprises 0.1 to 100 g/L of hexahydro-2,4,6-trimethyl-1,3,5-triazine or hexamethylenetetramine.

20 Claims, No Drawings

ELECTROLESS GOLD PLATING SOLUTION AND ELECTROLESS GOLD PLATING METHOD

BACKGROUND OF THE INVENTION

1. Field of the Invention

The present invention relates to an electroless gold plating solution and an electroless gold plating method. In particular, the present invention relates to a reduction type electroless gold plating technique capable of directly subjecting a plated coating film made of an underlying metal such as copper, nickel, or palladium to plate processing.

2. Description of the Related Art

In recent years, development of electronic components and semiconductor parts has advanced. An advanced mounting technique for realizing a small-sized semiconductor package having a large capacity has been required. Therefore, for example, a plating technique has been known, which forms a circuit pattern on a substrate using a metal such as copper having low electrical resistance when manufacturing the semiconductor package, and further performs nickel plating, palladium plating, and gold plating to form a joined part.

A nickel plated coating film is used as a barrier film for preventing erosion of a copper circuit caused by solder. A palladium-plated coating film is used as a barrier film for preventing diffusion of the nickel plated coating film to a gold plated coating film. Since the gold plated coating film has low electrical resistance and good solder wettability, the gold plated coating film is applied to the final finish. Therefore, a joined part having excellent joining properties such as soldering or wire bonding, can be formed with a plated coating film made of an underlying metal such as nickel or palladium and the gold plated coating film.

As the above-mentioned plating technique, there has been known a method for subjecting the underlying metal such as palladium to immersion gold plate processing to secure adhesion between the plated coating film and the underlying metal. However, since the immersion gold plate processing stops the reaction when the underlying metal is wholly substituted, the immersion gold plate processing limits a film thickness capable of being formed. On the other hand, formation of a thick gold plated coating film may be required for a portion joined with wire bonding. In order to form the thick gold plated coating film, gold plate processing is performed, which has two steps of subjecting the underlying metal to immersion gold plate processing to secure adhesion and then further subjecting the underlying metal to reduction type electroless gold plating. For example, Patent Document 1 discloses an electroless gold plating solution made of a gold ion, a complexing agent, a thiourea compound, and a phenyl compound as a reduction type electroless gold plating solution used after the immersion gold plate processing.

A plate processing operation itself is complicated by subjecting the underlying metal such as palladium to immersion gold plate processing and then subjecting the underlying metal to reduction type electroless gold plate processing. The immersion gold plate processing deposits gold using the difference between oxidation-reduction potentials of the plated coating film and the underlying metal. The immersion gold plate processing may partially form severe corrosion of the underlying metal. Another problem pointed out is that such a defect reduces joining properties. For example, Patent Documents 2 and 3 can realize gold plate processing which suppresses the corrosion of the underlying metal. These electroless gold plating baths can suppress the corrosion of the underlying metal. However, the unstable electroless gold plating baths and unfavorable appearance of the gold plating thereof are pointed out.

An electroless gold plating solution containing at least one kind of compound selected from the group consisting of formaldehyde bisulfites, rongalit, and hydrazines as a reducing agent (see Patent Document 4), and an electroless gold plating solution containing a water-soluble gold salt, a complexing agent, and an aldehyde compound having a predetermined structure (see Patent Document 5) have been proposed as an electroless gold plating solution improving the above-mentioned conventional technique. These electroless gold plating solutions have a desired deposition rate, and provide a good appearance. The underlying metal such as nickel or palladium can be also directly subjected to gold plate processing. However, since the solutions include toxic formaldehyde, the solutions are not preferable for a plate processing environment.

PRIOR ART DOCUMENTS

Patent Document

Patent Document 1: Japanese Patent Publication No. 2866676

Patent Document 2: Japanese Patent Laid-Open No. 2004-137589

Patent Document 3: International Publication No. WO2004/111287

Patent Document 4: Japanese Patent Laid-Open No. 2008-174774

Patent Document 5: Japanese Patent Laid-Open No. 2008-144188

DISCLOSURE OF THE INVENTION

Problems to be Solved by the Invention

As described above, the electroless gold plating techniques of Patent Documents 4 and 5 can suppress the corrosion of the underlying metal and omit the immersion gold plate processing. However, it is necessary to severely manage a work environment in the electroless gold plating techniques in order to safely perform plate processing work.

It is an object of the present invention to provide a reduction type electroless gold plating solution capable of directly subjecting a plated coating film made of an underlying metal such as copper, nickel or palladium to gold plate processing, of forming a thick gold plated coating film having a thickness of 0.1 μm or more, of forming a uniform gold plated coating film, and of safely performing plating work without containing a toxic substance as a plating solution component.

Means for Solving the Problems

The present inventors diligently studied the conventional electroless gold plating solution composition in order to solve the above-mentioned problems, and conceived of the present invention related to an electroless gold plating solution having a plating solution composition as shown below.

An electroless gold plating solution of the present invention comprises: a water-soluble gold compound; and hexahydro-2,4,6-trimethyl-1,3,5-triazine or hexamethylenetetramine. Although the electroless gold plating solution of the present invention is a so-called reduction type, a plated coating film made of an underlying metal such as copper, nickel, or palladium can be directly subjected to gold plate processing with the use of the electroless gold plating solution. The electroless gold plating solution can thicken gold plating. Because hexahydro-2,4,6-trimethyl-1,3,5-triazine (see Formula 1) or hexamethylenetetramine (see Formula 2) contained in the electroless gold plating solution is not a toxic substance such as formaldehyde, plating work can be safely performed. A gold plated coating film having a uniform thickness can be easily formed by the electroless gold plating solution of the present invention.

[Formula 1]

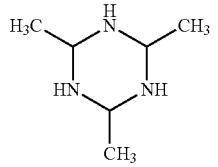

[Formula 2]

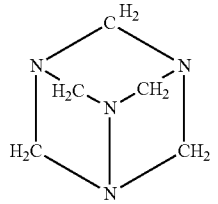

Preferably, the electroless gold plating solution of the present invention contains 0.1 to 100 g/L of hexahydro-2,4,6-trimethyl-1,3,5-triazine or hexamethylenetetramine. When a content thereof is less than 0.1 g/L, plate processing cannot be performed. When the content is more than 100 g/L, the water-soluble gold compound is reduced and deposited to produce precipitation of gold in the plating solution. More preferably, the content is 1 to 50 g/L.

Both a cyanogen gold salt and a non-cyanogen gold salt as a gold salt can be used for the water-soluble gold compound in the electroless gold plating solution of the present invention. Gold(I) potassium cyanide and gold(II) potassium cyanide or the like can be used as the water-soluble gold compound of the cyanogen gold salt. A chloraurate, a gold sulfite salt, a gold thiosulfate salt, and a gold thiomalate salt or the like can be used as the non-cyanogen gold salt. These can be used alone or two or more kinds of them can be used in combination. Of these, the gold(I) potassium cyanide is preferable. A content of the water-soluble gold compound is preferably in a range of 0.1 to 10 g/L as gold. When the content of the gold is less than 0.1 g/L, a deposition reaction of the gold is reduced. When the content is more than 10 g/L, stability of the plating solution is reduced, and an amount of consumption of the gold is increased by carrying out the plating solution at the time of the plate processing. Thereby, the content of more than 10 g/L is not economically preferable. Particularly, the content of the gold is more preferably 0.5 to 5 g/L.

A publicly-known complexing agent used in the electroless gold plating solution can be used as a complexing agent for the gold in the electroless gold plating solution of the present invention. For example, cyanogen salts such as sodium cyanide and potassium cyanide can be used. Examples of a non-cyanogen salt include a sulfite salt, a thiosulfate salt, a thiomalate salt, and a thiocyanate salt. These can be used alone or two or more kinds of them can be used in combination. Of these, the sulfite salt and the thiosulfate salt are preferable. A content thereof is preferably in a range of 0.01 to 200 g/L. When a content of the complexing agent is less than 0.01 g/L, a complexing force of the gold is reduced to reduce stability. When the content is more than 200 g/L, stability of the plating solution is improved. However, recrystallization is generated in the solution, or an economical burden is placed. The content is more preferably 0.1 to 100 g/L.

The electroless gold plating solution of the present invention preferably includes an amine compound. As the amine compound, there can be used monoalkanolamine, dialkanolamine, trialkanolamine, ethylenetriamine, m-hexylamine, tetramethylenediamine, pentamethylenediamine, hexamethylenediamine, heptamethylenediamine, ethylenediamine, diethylenetriamine, triethylenetetramine, tetraethylenepentamine, pentaethylenehexamine, dimethylamine, triethanolamine, hydroxylamine sulfate, HEDTA, NTA, EDTA, and a DTPA salt or the like. Of these, ethylenediamine, diethylenetriamine, triethylenetetramine, tetraethylenepentamine, and pentaethylenehexamine are preferable. A content of the amine compound is preferably in a range of 0.1 to 100 g/L. When an amount of the amine compound to be blended is less than 0.1 g/L, an effect of addition of the amine compound is not sufficiently exhibited. Because the stability of the plating solution may be reduced when the amount is more than 100 g/L, the amount is not preferable. Furthermore, the amount is more preferably in a range of 0.5 to 10 g/L. Water-soluble amines are obtained by adding one or more kinds of the above-mentioned amine compounds. Thereby, a deposition rate of the electroless gold plating solution can be increased, and an appearance of the gold plating and throwing power of the plating can be improved. In addition, solution stability can be remarkably improved.

Although the contents of the water-soluble gold compound and the complexing agent for gold can be suitably adjusted to the optimal content in the electroless gold plating solution of the present invention, the content of the water-soluble gold compound is preferably 0.5 to 5 g/L in terms of gold. The content of the complexing agent for gold is preferably 0.1 to 100 g/L. A solution temperature is preferably 60 to 90° C. The pH of the plating solution is preferably 6 to 9.

A pH buffering agent and a crystal adjuster can be also added to the electroless gold plating solution of the present invention. For example, phosphoric acid or a phosphoric acid compound, and boric acid or a boric acid compound or the like as the pH buffering agent can be added in a concentration range of 0.1 to 100 g/L in order to stabilize the pH of the plating solution. A lead compound and a thallium compound or the like as the crystal adjuster can be added in a concentration range of 0.00001 to 0.1 g/L in terms of a metal content in order to improve physical properties such as hardness of the plated coating film.

The gold plated coating film formed with the electroless gold plating solution of the present invention is suitable when a joined part is formed by joining such as soldering or wire bonding. When the joined part is formed on an electronic component such as a printed-wiring board, a semiconductor package, an anisotropic conductive film (ACF), or a semiconductor wafer, the gold plated coating film is preferably formed with the electroless gold plating solution of the present invention.

Effect of the Invention

As described above, the present invention can directly subject a plated coating film made of an underlying metal such as copper, nickel or palladium to gold plate processing, perform thick gold plate processing, and safely perform plating work.

BEST MODE FOR CARRYING OUT THE INVENTION

Hereinafter, the preferred embodiments in the present invention will be described.

In order to evaluate an electroless gold plating solution of the present invention, a printed-wiring board (manufactured by Tanaka Kikinzoku Kogyo K.K.) and an evaluation substrate were used. A copper circuit was formed on the printed-wiring board. The evaluation substrate included a copper plate and various underlying metals (nickel, palladium, gold) covering the copper plate. A pickling degreasing solution and plating solutions will be described below. The solutions having product names to which symbol * is applied are products manufactured by Electroplating Engineers of Japan Ltd.

The printed-wiring board was subjected to acidic degreasing (*ETrex 15, 25° C., for 1 minute). A copper surface was subjected to soft etching treatment (*Microfab 74, 25° C., for 1 minute). The copper surface was subjected to sulfuric acid activation treatment using 10% sulfuric acid. Then, the copper surface was subjected to catalyst addition treatment (*Lectroless AC2, 25° C., for 1 minute), and was then subjected to electroless nickel treatment (*Lectroless NP7600, 86° C., for 15 minutes) to form a nickel plated coating film having a thickness of 5 μm. Subsequently, a surface of the nickel plated coating film was subjected to electroless palladium treatment (*Lectroless Pd2000S, 52° C., for 10 minutes) to form a palladium plated coating film having a thickness of 0.1 μm. The resultant printed-wiring board was used for Comparative Example 1 and Examples 1 to 15 shown in Table 1.

The evaluation substrate including the copper plate and the various underlying metals (nickel, palladium, gold) covering the copper plate was used for Comparative Examples 2 to 5 and Examples 16 to 19 shown in Table 1. Production conditions of the evaluation substrate including the copper plate and the various underlying metals covering the copper plate will be shown below.

Copper plate: A copper plate measuring 20 mm vertical by 40 mm horizontal by 0.3 mm thick was subjected to acidic degreasing (*ETrex 15, 25° C., for 1 minute). A copper surface was subjected to soft etching treatment (*Microfab 74, 25° C., for 1 minute). The copper surface was subjected to sulfuric acid activation treatment using 10% sulfuric acid.

Nickel: A copper plate was subjected to acidic degreasing (*ETrex 15, 25° C., for 1 minute). A copper surface was subjected to soft etching treatment (*Microfab 74, 25° C., for 1 minute). The copper surface was subjected to sulfuric acid activation treatment using 10% sulfuric acid. Then, the copper surface was subjected to catalyst addition treatment (*Lectroless AC2, 25° C., for 1 minute), and was then subjected to electroless nickel treatment (*Lectroless NP7600, 86° C., for 15 minutes) to form a nickel coating film having a thickness of 5 μm.

Palladium: A copper plate was subjected to acidic degreasing (*ETrex 15, 25° C., for 1 minute). A copper surface was subjected to soft etching treatment (*Microfab 74, 25° C., for 1 minute). The copper surface was subjected to sulfuric acid activation treatment using 10% sulfuric acid. Then, the copper surface was subjected to catalyst addition treatment (*Lectroless AC2, 25° C., for 1 minute), and was then subjected to electroless nickel treatment (*Lectroless NP7600, 86° C., for 15 minutes) to form a nickel coating film having a thickness of 5 μm. A palladium coating film having a thickness of 5 μm was formed on the nickel coating film using an electrolytic palladium plating solution (*Palladex ADP700).

Gold: A copper plate was subjected to acidic degreasing (*ETrex 15, 25° C., for 1 minute). A copper surface was subjected to soft etching treatment (*Microfab 74, 25° C., for 1 minute). The copper surface was subjected to sulfuric acid activation treatment using 10% sulfuric acid. Then, the copper surface was subjected to catalyst addition treatment (*Lectroless AC2, 25° C., for 1 minute), and was then subjected to electroless nickel treatment (*Lectroless NP7600, 86° C., for 15 minutes) to form a nickel coating film having a thickness of 5 μm. A gold coating film having a thickness of 5 μm was formed on the nickel coating film with the use of an electrolytic gold plating solution (*Temperex MLA200).

The evaluation substrate including the various underlying metals covering the copper plate was formed so as to have a thickness of 5 μm or more to eliminate the influence of copper as a basis metal. Products manufactured by Electroplating Engineers of Japan Ltd. have product names to which symbol * is applied.

Film thicknesses of gold when plating was performed under various solution compositions and operation conditions (pH of each of the plating solutions shown in Table 1 was set to 7.5 and a solution temperature was 80° C.) were shown in Table 1. A thickness of gold plating formed on the copper circuit of the printed-wiring board was measured with an X-ray fluorescence film thickness meter. A thickness of gold plating formed on the copper plate (basis metal) was calculated from the weight difference before and after electroless gold plate processing. Symbols E and F shown in Table 1 denote compositions indispensable for the electroless gold plating solution of the present invention. Symbol D denotes an amine compound added as a complexing agent.

TABLE 1

| No | A g/L | B g/L | C g/L | D g/L | E g/L | F g/L | Time Minute | Underlying metal | Film thickness of gold μm |
|---|---|---|---|---|---|---|---|---|---|
| Comparative Example 1 | 2.0 | 0 | — | 20.0 | 0 | 0 | 15 | Pd | 0.016 |
| Example 1 | 2.0 | 0 | — | 20.0 | 0.5 | 0 | 15 | Pd | 0.045 |
| Example 2 | 2.0 | 0 | — | 20.0 | 1.0 | 0 | 15 | Pd | 0.056 |
| Example 3 | 2.0 | 0 | — | 20.0 | 2.0 | 0 | 15 | Pd | 0.068 |
| Example 4 | 2.0 | 0 | — | 20.0 | 4.0 | 0 | 15 | Pd | 0.082 |
| Example 5 | 2.0 | 0 | — | 20.0 | 0 | 0.5 | 15 | Pd | 0.083 |
| Example 6 | 2.0 | 0 | — | 20.0 | 0 | 1.0 | 15 | Pd | 0.130 |
| Example 7 | 2.0 | 0 | — | 20.0 | 0 | 1.5 | 15 | Pd | 0.145 |
| Example 8 | 2.0 | 0 | — | 20.0 | 0 | 2.0 | 15 | Pd | 0.176 |
| Example 9 | 2.0 | 0.5 | — | 20.0 | 4.0 | 0 | 15 | Pd | 0.135 |
| Example 10 | 2.0 | 0.5 | — | 20.0 | 4.0 | 0 | 30 | Pd | 0.223 |

TABLE 1-continued

| No | A g/L | B g/L | C g/L | D g/L | E g/L | F g/L | Time Minute | Underlying metal | Film thickness of gold μm |
|---|---|---|---|---|---|---|---|---|---|
| Example 11 | 2.0 | 0.5 | — | 20.0 | 4.0 | 0 | 45 | Pd | 0.314 |
| Example 12 | 2.0 | 0.5 | — | 20.0 | 4.0 | 0 | 60 | Pd | 0.399 |
| Example 13 | 2.0 | — | 30 | 1.0 | 10.0 | 0 | 15 | Pd | 0.063 |
| Example 14 | 2.0 | — | 50 | 1.0 | 10.0 | 0 | 15 | Pd | 0.058 |
| Example 15 | 2.0 | — | 50 | 0 | 10.0 | 0 | 15 | Pd | 0.043 |
| Comparative Example 2 | 2.0 | 0 | — | 1.0 | — | 0 | 15 | Au | 0.003 |
| Comparative Example 3 | 2.0 | 0 | — | 1.0 | — | 0 | 15 | Pd | 0.032 |
| Comparative Example 4 | 2.0 | 0 | — | 1.0 | — | 0 | 15 | Ni | 0.037 |
| Comparative Example 5 | 2.0 | 0 | — | 1.0 | — | 0 | 15 | Cu | 0.000 |
| Example 18 | 2.0 | 0 | — | 1.0 | 4.0 | 0 | 15 | Au | 0.081 |
| Example 17 | 2.0 | 0 | — | 1.0 | 4.0 | 0 | 15 | Pd | 0.126 |
| Example 18 | 2.0 | 0 | — | 1.0 | 4.0 | 0 | 15 | Ni | 0.149 |
| Example 19 | 2.0 | 0 | — | 1.0 | 4.0 | 0 | 15 | Cu | 0.071 |

(Explanation of symbols)
A: Gold potassium cyanide (concentration as Au)
B: Potassium cyanide
C: Sodium sulfite
D: Triethylenetetramine
E: Hexahydro-2,4,6-trimethyl-1,3,5-triazine trihydrate
F: Hexamethylenetetramine The gold plating appearance of each of the evaluation substrates after the gold plate processing was investigated. It was confirmed that all the evaluation substrates were uniformly subjected to the gold plate processing in Examples 1 to 19. As shown in Table 1, it was found that each of the underlying metals can be subjected to gold plate processing of a predetermined thickness with the use of the electroless gold plating solution of the present invention. Even when an amine compound D as the complexing agent was not added (Example 15), the gold plate processing can be performed. On the other hand, in Comparative Examples 1 to 5, a gold plated coating film having a film thickness of 0.04 μm or more could not be formed on each of the underlying metals.

Next, the evaluation results of uniformity of the gold plated coating film will be described. The uniformity of the gold plated coating film was evaluated as follows. The printed-wiring board (manufactured by Tanaka Kikinzoku Kogyo K.K.) on which the copper circuit was formed was subjected to plate processing of a thickness of 5 μM with the use of electroless nickel (*Lectroless NP7600). Furthermore, the printed-wiring board was subjected to plate processing of a thickness of 0.1 μm with the use of electroless palladium (*Lectroless Pd2000S). The resultant printed-wiring board was subjected to gold plate processing with the use of the electroless gold plating solutions (plating conditions are the same as those of Table 1) of Examples 4 and 6. The thickness of the gold plated coating film at each of six portions of the evaluation substrate was measured by the X-ray fluorescence film thickness meter.

Uniformity of each of gold plating solutions of the following Comparative Examples 6 and 7 for comparison was evaluated.

Comparative Example 6

A thallium salt of 5 mg/L as thallium was added to the plating solution of Comparative Example 2 to produce an electroless gold plating solution having pH of 5.5 and a solution temperature of 85° C. Gold plate processing was performed for 15 minutes using the electroless gold plating solution.

Comparative Example 7

Gold plate processing was performed for 15 minutes with the use of an electroless gold plating solution obtained by changing hexahydro-2,4,6-trimethyl-1,3,5-triazine trihydrate (4 g/L) of Example 4 to formalin (1 mL/L).

The results obtained by measuring the thicknesses of the gold plated coating film at six portions of each of the evaluation substrates are shown in Table 2.

TABLE 2

| | Film thickness of gold (μm) | | | | | | Average film thickness μm | CV value % |
|---|---|---|---|---|---|---|---|---|
| | 1 μm | 2 μm | 3 μm | 4 μm | 5 μm | 6 μm | | |
| Example 4 | 0.078 | 0.083 | 0.087 | 0.080 | 0.081 | 0.083 | 0.082 | 3.5 |
| Example 6 | 0.125 | 0.128 | 0.130 | 0.130 | 0.133 | 0.132 | 0.130 | 2.0 |
| Comparative Example 6 | 0.090 | 0.077 | 0.056 | 0.060 | 0.060 | 0.057 | 0.067 | 20.9 |
| Comparative Example 7 | 0.170 | 0.164 | 0.164 | 0.179 | 0.176 | 0.165 | 0.170 | 3.9 |

As a Coefficient of variation (CV) value showing uniformity of a thickness of a coating film in each of the plating solutions in Table 2, Example 4 was 3.5%; Example 6, 2.0%; Comparative Example 6, 20.9%; and Comparative Example 7, 3.9%. The results of the uniformity evaluation of the gold plated coating film revealed that a uniform gold plated coating film can be formed with the electroless gold plating solution of the present invention.

Furthermore, solder wettability and spreadability were evaluated using the electroless gold plating solution of Example 4 shown in Tables 1 and 2. The results will be described. The solder wettability and spreadability were evaluated with the use of an evaluation sample. The evaluation sample had a joined part formed by sequentially applying a nickel plated coating film, a palladium plated coating film, and a gold plated coating film on a surface of a copper plate (basis material) measuring 20 mm vertical by 40 mm horizontal by 0.3 mm thick, by plate processing. Hereinafter, each of plate processing conditions when the joined part is formed will be described.

As a procedure for forming the joined part, first, a copper plate was subjected to acidic degreasing (*ETrex 15, 25° C., for 1 minute). A surface was subjected to soft etching treatment (*Microfab 74, 25° C., for 1 minute). The surface was subjected to sulfuric acid activation treatment using 10% sulfuric acid. Then, the surface was subjected to catalyst addition treatment (*Lectroless AC2, 25° C., for 1 minute), and was then electroless nickel treatment (*Lectroless NP7600, 86° C., for 15 minutes) to form a nickel coating film having a thickness of 5 μm. Subsequently, a surface of the nickel plated coating film was subjected to electroless palladium treatment (*Lectroless Pd2000S, 52° C., for 10 minutes) to form a palladium plated coating film having a thickness of 0.1 μm. A gold plated coating film having a thickness of 0.082 μm was formed on a surface of the palladium plated coating film with the use of the electroless gold plating solution of Example 4 (80° C. for 15 minutes).

A test for evaluating the solder wettability and spreadability of the produced evaluation sample was performed. The test for evaluating the solder wettability and spreadability was conducted as follows.

(1) A reflow (250° C./4 minutes) of the evaluation sample was conducted five times.
(2) A solder ball was set (760 μmϕ, flux application) on the evaluation sample.
(3) A reflow (250° C./4 minutes) was conducted once to melt solder.
(4) A spreading ratio (%) was calculated by measuring a solder wetting-spreading diameter (μmϕ).

Conditions of Test for Evaluating Solder Wettability and Spreadability

Solder ball: 760 μmϕ (Sn96.5/Ag3.0/Cu0.5)
Flux: RMA-367EN (manufactured by Alfa Metals)
Reflow atmosphere: Air As a result of evaluating the solder wettability and spreadability, it was found that the joined part formed by using the electroless gold plating solution of the present invention has a solder wetting-spreading ratio of 200% or more and exhibits good solder wettability and spreadability.

INDUSTRIAL APPLICABILITY

The gold plated coating film having excellent film thickness uniformity can be formed on the underlying metal such as nickel or palladium, to produce excellent solderability or wire bonding properties. Plating work can be safely performed, and a load on the environment can be also reduced.

What is claimed is:

1. An electroless gold plating solution comprising: a water-soluble gold compound; and hexahydro-2,4,6-trimethyl-1,3,5-triazine.

2. The electroless gold plating solution according to claim 1, comprising a complexing agent for gold.

3. The electroless gold plating solution according to claim 1, comprising an amine compound.

4. The electroless gold plating solution according to claim 1, comprising 0.1 to 100 g/L of hexahydro-2,4,6-trimethyl-1,3,5-triazine.

5. The electroless gold plating solution according to claim 3, comprising 0.1 to 100 g/L of the amine compound.

6. An electroless gold plating method comprising the step of subjecting a metallic surface of a substrate to electroless gold plate processing with the electroless gold plating solution according to claim 1.

7. An electronic component comprising a joined part subjected to an electroless gold plate processing by the electroless gold plating method according to claim 6.

8. The electroless gold plating solution according to claim 2, comprising an amine compound.

9. The electroless gold plating solution according to claim 2 comprising 0.1 to 100 g/L of hexahydro-2,4,6-trimethyl-1,3,5-triazine.

10. The electroless gold plating solution according to claim 3 comprising 0.1 to 100 g/L of hexahydro-2,4,6-trimethyl-1,3,5-triazine.

11. The electroless gold plating solution according to claim 8 comprising 0.1 to 100 g/L of hexahydro-2,4,6-trimethyl-1,3,5-triazine.

12. The electroless gold plating solution according to claim 8, comprising 0.1 to 100 g/L of the amine compound.

13. The electroless gold plating solution according to claim 4, comprising 0.1 to 100 g/L of the amine compound.

14. The electroless gold plating solution according to claim 9, comprising 0.1 to 100 g/L of the amine compound.

15. The electroless gold plating solution according to claim 10, comprising 0.1 to 100 g/L of the amine compound.

16. The electroless gold plating solution according to claim 1, comprising 0.1 to 100 g/L of the amine compound.

17. An electroless gold plating method comprising the step of subjecting a metallic surface of a substrate to electroless gold plate processing with the electroless gold plating solution according to claim 2.

18. An electroless gold plating method comprising the step of subjecting a metallic surface of a substrate to electroless gold plate processing with the electroless gold plating solution according to claim 3.

19. An electroless gold plating method comprising the step of subjecting a metallic surface of a substrate to electroless gold plate processing with the electroless gold plating solution according to claim 4.

20. An electroless gold plating method comprising the step of subjecting a metallic surface of a substrate to electroless gold plate processing with the electroless gold plating solution according to claim 5.

* * * * *